US010301077B1

(12) United States Patent
Finlow-Bates

(10) Patent No.: US 10,301,077 B1
(45) Date of Patent: May 28, 2019

(54) ELECTRONIC CIGARETTE TANK

(71) Applicant: Keir Finlow-Bates, Kangasala (FI)

(72) Inventor: Keir Finlow-Bates, Kangasala (FI)

( * ) Notice: Subject to any disclaimer, the term of this patent is extended or adjusted under 35 U.S.C. 154(b) by 0 days.

(21) Appl. No.: 16/208,006

(22) Filed: Dec. 3, 2018

(51) Int. Cl.
*B65D 39/08* (2006.01)
*B65B 3/04* (2006.01)
*A24F 47/00* (2006.01)

(52) U.S. Cl.
CPC ..... *B65D 39/08* (2013.01); *A24F 47/008* (2013.01); *B65B 3/04* (2013.01)

(58) Field of Classification Search
CPC .. B65B 3/04; B65B 3/08; B65D 39/08; A24F 47/008
See application file for complete search history.

(56) References Cited

U.S. PATENT DOCUMENTS

| | | | | |
|---|---|---|---|---|
| 3,922,929 | A | 12/1975 | Marchello | |
| 4,090,631 | A | 5/1978 | Grussen | |
| 5,533,633 | A | 7/1996 | King | |
| 8,375,957 | B2 | 2/2013 | Hon | |
| 9,723,876 | B2 | 8/2017 | Cadieux | |
| 9,795,169 | B1 * | 10/2017 | Zhu | A24F 47/008 |
| 9,980,522 | B1 * | 5/2018 | Heidl | A24F 47/008 |
| 9,993,025 | B2 | 6/2018 | Alarcon | |
| 10,015,991 | B1 | 7/2018 | Tucker | |
| 10,028,532 | B2 | 7/2018 | Zhu | |
| 10,070,667 | B2 | 9/2018 | Lord | |
| 2013/0087160 | A1 * | 4/2013 | Gherghe | A24F 1/00 131/329 |
| 2015/0245661 | A1 * | 9/2015 | Milin | A24F 47/008 131/329 |
| 2016/0120226 | A1 * | 5/2016 | Rado | A24F 47/008 131/329 |
| 2016/0192708 | A1 | 7/2016 | DeMeritt | |
| 2016/0227837 | A1 | 8/2016 | Hammel | |
| 2016/0332754 | A1 * | 11/2016 | Brown | B65B 3/10 |
| 2017/0013880 | A1 | 1/2017 | O'Brien | |
| 2017/0367404 | A1 * | 12/2017 | Li | H05B 1/0244 |

FOREIGN PATENT DOCUMENTS

| | | | |
|---|---|---|---|
| CN | 1284493 | C | 11/2006 |
| CN | 206699398 | U | 12/2017 |
| CN | 108349597 | A | 7/2018 |
| DE | 202012004792 | U1 | 6/2012 |
| DE | 202014008768 | U1 | 11/2014 |
| EP | 3199043 | A1 | 8/2017 |
| EP | 3130238 | B1 | 5/2018 |

* cited by examiner

*Primary Examiner* — Ryan A Reis

(57) ABSTRACT

A tank for containing e-liquid in an electronic cigarette assembly is disclosed. The tank comprises a cap and a body. The cap is connectable to the body through a screw thread with a specified handedness, and the body is connected to a battery assembly through a second screw thread with an opposite handedness to the screw thread of the cap. A construction of the tank ensures than when opening the cap, the body is not inadvertently unscrewed from the battery, and likewise when removing the body from the battery the cap is not inadvertently unscrewed from the body, thus preventing unintended e-liquid spillage and improving ease of removal of the cap and the body.

8 Claims, 8 Drawing Sheets

ELECTRONIC CIGARETTE TANK

TECHNICAL FIELD

This disclosure relates to an electronic cigarette, and in particular to an improved tank or reservoir for the electronic cigarette.

BACKGROUND

Electronic cigarettes typically comprise an atomizer to vaporize a solution containing nicotine commonly known as e-liquid, a battery to power the atomizer, and a reservoir or a tank to contain the e-liquid for atomization. In many embodiments of electronic cigarettes, the tank also comprises an atomizer and a mouthpiece.

In current electronic cigarette designs there is a problem in that replenishing the tank with the e-liquid may be a difficult process. As the e-liquid may contain levels of nicotine that are detrimental to health, contact with skin is not advisable. Furthermore, the e-liquid may have a high price, and therefore users of the electronic cigarette do not wish to waste e-liquid unnecessarily through accidental spillage. Users also wish to be able to open and close the tank or replace the tank in a simple manner without needing to resort to pliers or other external tools.

Common designs for the tank consist of a body with a cap at one end that may be unscrewed or detached in order to refill the tank with the e-liquid, and a screw fixture at an other end of the body for attaching the tank to the battery in order to replace the body if necessary, for example due to damage or accumulation of dirt and residues, as taught in USPTO publication number 20160227837.

Those skilled in the art will recognize that the one end and the other end may not be diametrically opposed, but may be placed on adjacent sides or at any angle to each other, and in the current disclosure a use of the terms "one end" and "other end" should not be read to limit the present disclosure.

In conventional designs featuring a screw threaded attachment there is a risk that on removing the cap from the body of the tank, the body may inadvertently be removed from the battery, and similarly removing the body from the battery may result in inadvertently removing the cap from the body and possibly spilling e-liquid. Therefore a need exists for an improved tank system.

SUMMARY

In accordance with the present disclosure, an improved tank is presented for ensuring that removing the cap from the tank does not inadvertently remove the tank from the battery, and that removing the tank from the battery does not inadvertently remove the cap from the body.

In a preferred embodiment, a system for a tank of an electronic cigarette may comprise: a body defining a refillable reservoir for storing e-liquid, said body comprising a left-handed thread which is engaged by a corresponding matching left-handed thread formed within a battery assembly; and a cap for sealing or partially sealing the body, said cap comprising a right-handed thread which is engaged by a corresponding matching right-handed thread formed on a surface of the body.

In some embodiments, the right-handed thread may be formed on an outer surface of the cap and the corresponding matching right-handed thread may be formed on an inner surface of the body.

In the preferred embodiment, the right-handed thread may be formed on an inner surface of the cap and the corresponding matching right-handed thread may be formed on an outer surface of the body.

In some embodiments, the body may comprise a protrusion, and the left-handed thread may be formed on all or part of a surface of the protrusion.

In an other embodiment, a system for a tank for an electronic cigarette may comprise: a body defining a refillable reservoir for storing e-liquid and comprising a right-handed thread which is engaged by a corresponding matching right-handed thread formed within a battery assembly; and a cap for sealing the body comprising a left-handed thread which is engaged by a corresponding matching left-handed thread formed on a surface of the body.

In the other embodiment, the left-handed thread may be formed on an outer surface of the cap and the corresponding matching left-handed thread may be formed on an inner surface of the body.

In some embodiments, the left-handed thread may be formed on an inner surface of the cap and the corresponding matching left-handed thread may be formed on an outer surface of the body.

In some embodiments, the body may comprise a protrusion, and the right-handed thread may be formed on all or part of a surface of the protrusion.

A result of the embodiments disclosed above is that on loosening the cap of the tank, the body of the tank may be tightened into the battery assembly, and conversely, on loosening the tank from the battery assembly, the cap may be tightened into the body. Hence the result ensures that the cap is not inadvertently removed while removing the tank from the battery assembly, and similarly the tank is not inadvertently removed from the battery assembly when removing the cap from the tank.

Those skilled in the art will further appreciate the advantages and superior features found in this disclosure together with other important aspects thereof on reading the detailed description that follows in conjunction with the drawings.

BRIEF DESCRIPTION OF THE DRAWINGS

The components in the figures are not necessarily to scale, emphasis instead being placed upon illustrating the principles of the present disclosure. In the figures, like reference numerals designate corresponding parts throughout the different views.

DETAILED DESCRIPTION

Aspects of this disclosure will be described in the context of exemplary systems of tanks able to contain e-liquid, for use in an electronic cigarette, said tanks comprising at least a cap and a body.

Figure 1:
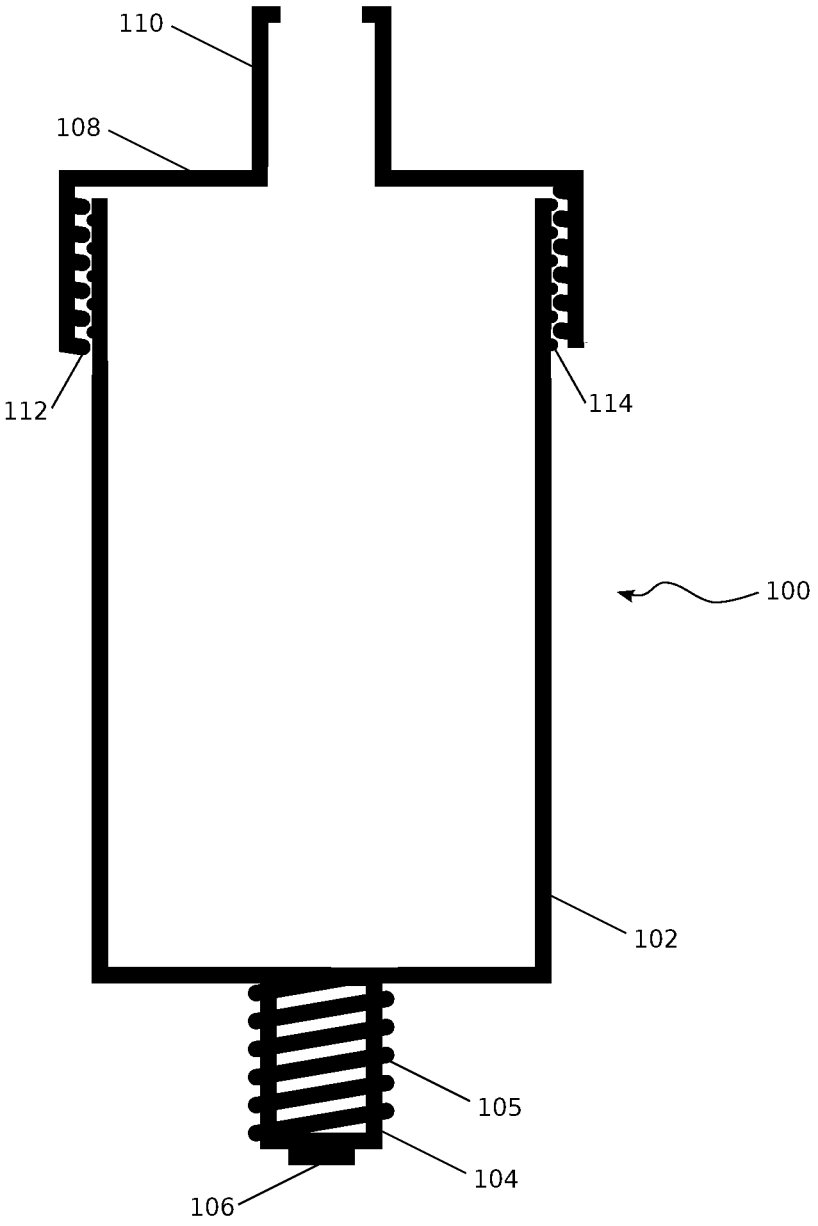
FIG. 1 is a cross-sectional view of components of a tank, in a first embodiment of the present disclosure.

In FIG. 1 a tank 100 comprising a cap 108 and a body 102 is presented, in a first embodiment of the present disclosure.

In some embodiments, the body 102 may comprise a protrusion 104 comprising a connection point 106 for a terminal of a power supply.

In some embodiments the protrusion 104 may feature a right-handed screw thread 105, said right-handed screw thread formed on a surface of the protrusion 104.

In some embodiments the body 102 may comprise a left-handed screw thread 114 formed on an outer surface of the body, and situated at an opposite end to the protrusion 104.

In some embodiments the cap 108 may comprise a mouthpiece 110.

In some embodiments the cap 108 may comprise a second left-handed screw thread 112 formed on an inner surface of the cap 108 and matching the left-handed screw thread 114 of the body 102, such that through engagement and counter-clockwise rotation the cap 108 may be sealed or partially sealed to the body 102, and conversely through clockwise rotation and disengagement the cap 108 may be removed from the body 102. Rotations are described as seen from a top of the cap, that is, the cap 108 is in front of the body 102.

Figure 2:
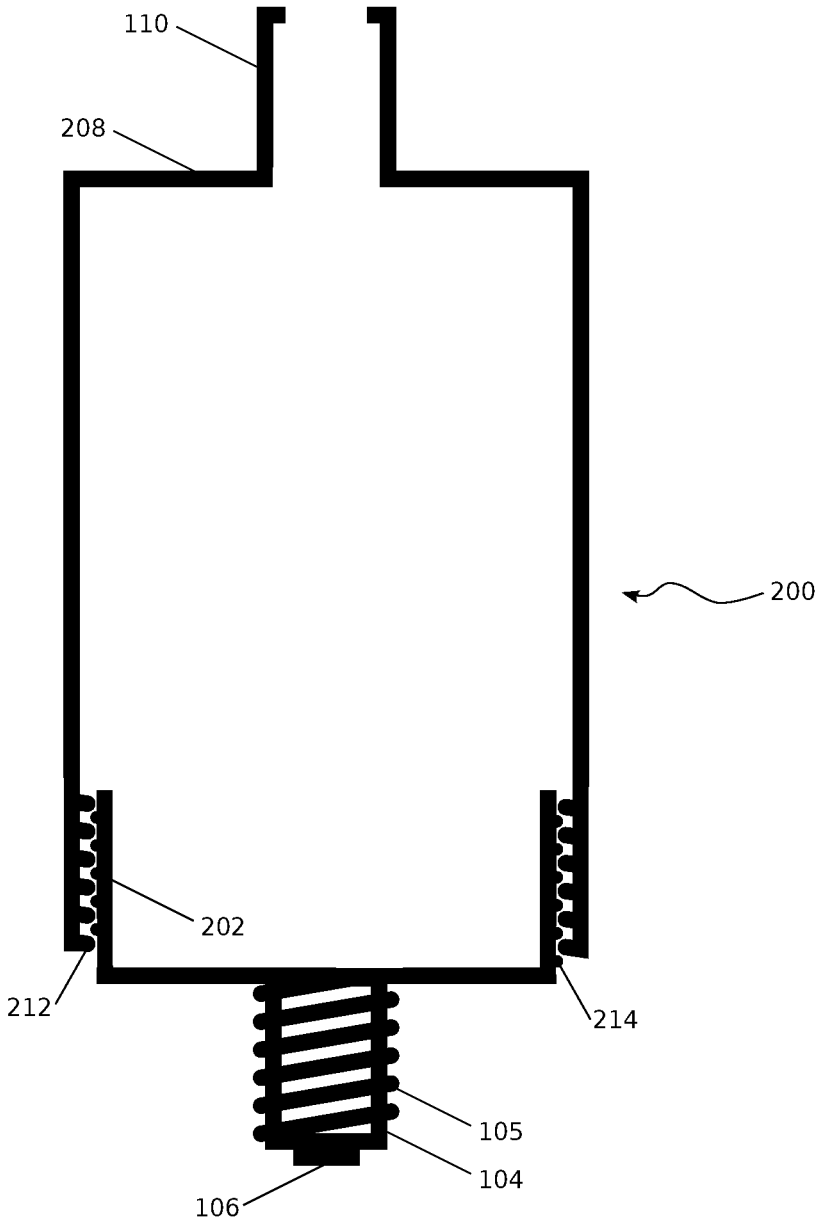
FIG. 2 is a cross-sectional view of components of a tank, in a second embodiment of the present disclosure.

In FIG. 2 a tank 200 comprising an elongated cap 208 and a body 202 is presented, in a second embodiment of the present disclosure.

In some embodiments the body 202 may comprise a left-handed screw thread 214 formed on an outer surface of the body, and situated at an adjacent end to the protrusion 104.

In some embodiments the elongated cap 208 may comprise a mouthpiece 110.

In some embodiments the elongated cap 208 may comprise a second left-handed screw thread 212 formed on an inner surface of the cap 208 and matching the left-handed screw thread 214 of the body 202, such that through engagement and counter-clockwise rotation the elongated cap 208 may be sealed or partially sealed to the body 202, and conversely through clockwise rotation and disengagement the elongated cap 208 may be removed from the body 202. Rotations are described as seen from a top of the elongated cap 208, that is, the elongated cap 208 is in front of the body 202.

Figure 3:
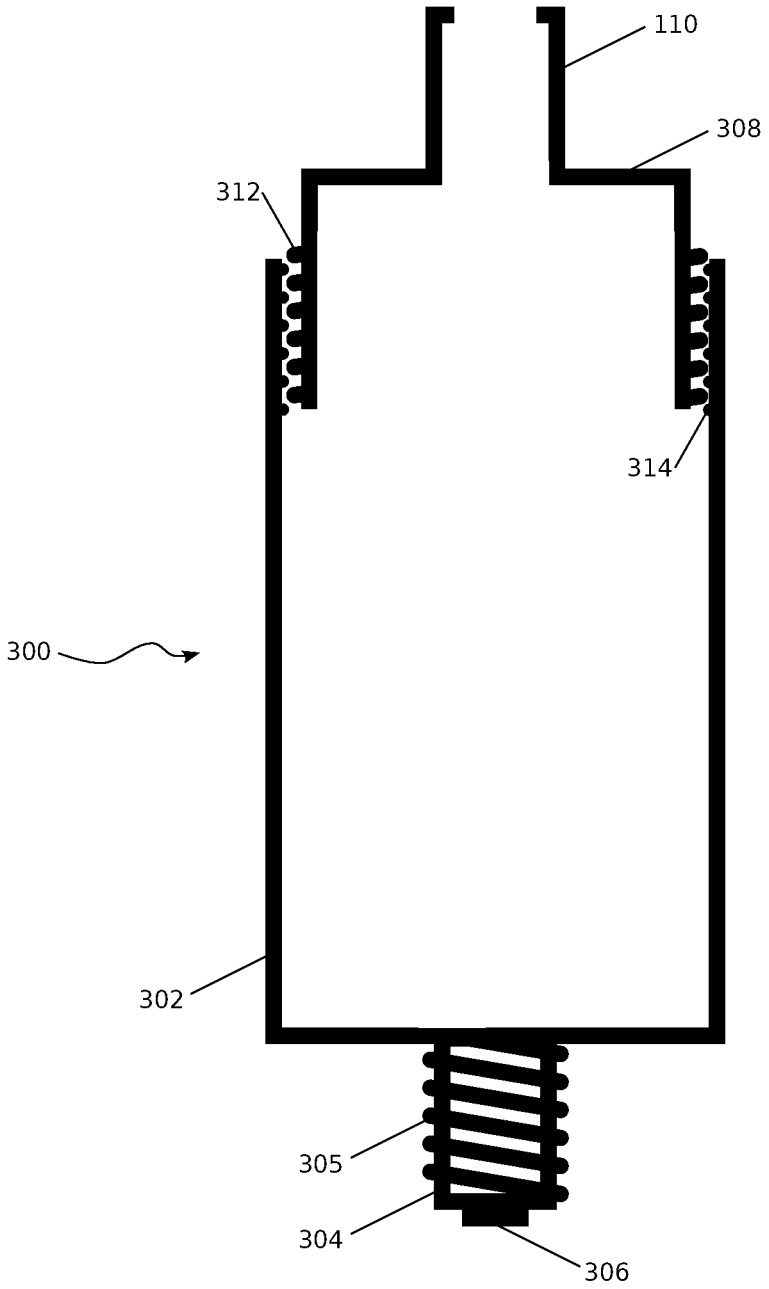
FIG. 3 is a cross-sectional view of components of a tank, in a third embodiment of the present disclosure.

In FIG. 3 a tank 300 comprising a cap 308 and a body 302 is presented, in a third embodiment of the present disclosure.

In some embodiments, the body 302 may comprise a protrusion 304 comprising a connection point 306 for a terminal of a power supply.

In some embodiments the protrusion 304 may feature a left-handed screw thread 305, said left-handed screw thread 305 formed on a surface of the protrusion 304.

In some embodiments the body 302 may comprise a right-handed screw thread 314 formed on an inner surface of the body, and situated at an opposite end to the protrusion 304.

In some embodiments the cap 308 may comprise a mouthpiece 110.

In some embodiments the cap 308 may comprise a second right-handed screw thread 312 formed on an outer surface of the cap 308 and matching the right-handed screw thread 314 of the body 302, such that through engagement and clockwise rotation the cap 308 may be sealed or partially sealed to the body 302, and conversely through counter-clockwise rotation and disengagement the cap 308 may be removed from the body 302. Rotations are described as seen from a top of the cap, that is, the cap 308 is in front of the body 302.

Figure 4:
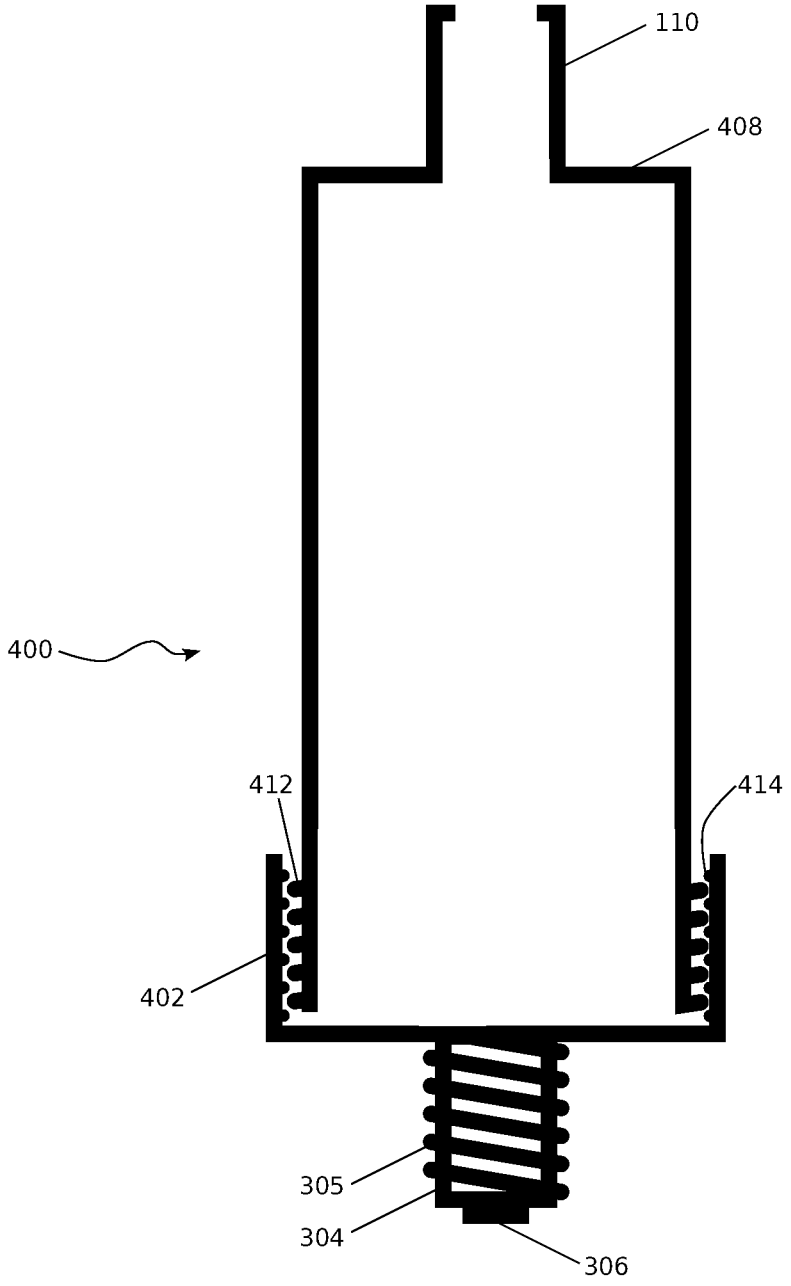
FIG. 4 is a cross-sectional view of components of a tank, in a fourth embodiment of the present disclosure.

In FIG. 4 a tank 400 comprising an elongated cap 408 and a body 402 is presented, in a fourth embodiment of the present disclosure.

In some embodiments the body 402 may comprise a right-handed screw thread 414 formed on an inner surface of the body, and situated at an adjacent end to the protrusion 304.

In some embodiments the elongated cap 408 may comprise a mouthpiece 110.

In some embodiments the elongated cap 408 may comprise a second right-handed screw thread 412 formed on an outer surface of the cap 408 and matching the right-handed screw thread 414 of the body 402, such that through engagement and clockwise rotation the elongated cap 408 may be sealed or partially sealed to the body 402, and conversely through counter-clockwise rotation and disengagement the elongated cap 408 may be removed from the body 402. Rotations are described as seen from a top of the elongated cap 408, that is, the elongated cap 408 is in front of the body 402.

Figure 5:
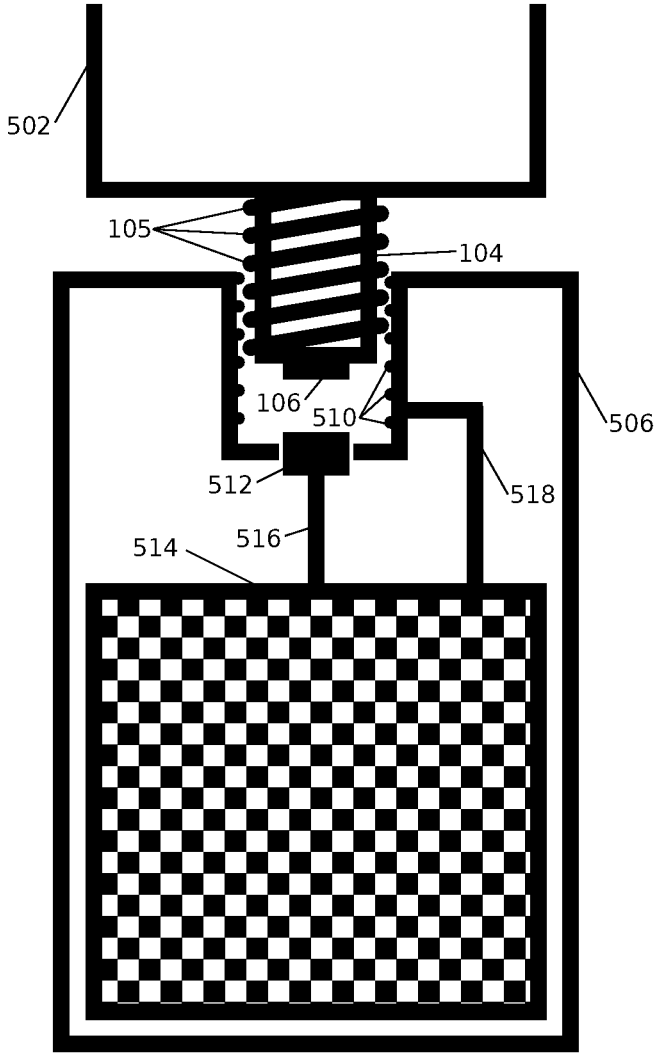
FIG. 5 is a cross-sectional view illustrating an engagement of a tank with a battery assembly, in a possible embodiment of the present disclosure.

In FIG. 5 an engagement or disengagement of a tank 502 to a battery assembly 506 is presented, in an embodiment of the present disclosure.

In some embodiments, as disclosed above, the tank 502 may comprise the protrusion 104, said protrusion 104 featuring the right-handed screw thread 105, said right-handed screw thread formed on the surface of the protrusion 104.

In some embodiments the battery assembly 506 may comprise a matching right-handed screw thread 510 recessed into the battery assembly 506.

The battery assembly 506 may also comprise: a battery 514 connected to a battery assembly connection point 512 via a terminal 516, and a connection terminal 518 connecting the battery 514 to the battery assembly 506.

Through engagement and clockwise rotation the tank 502 may be connected to the battery assembly 506, and conversely through counter-clockwise rotation and disengagement the tank 502 may be removed from the battery assembly 506. Rotations are described as viewed from a top of the tank 502, that is, the tank 502 is in front of the battery assembly 506 from such a view.

Figure 6:
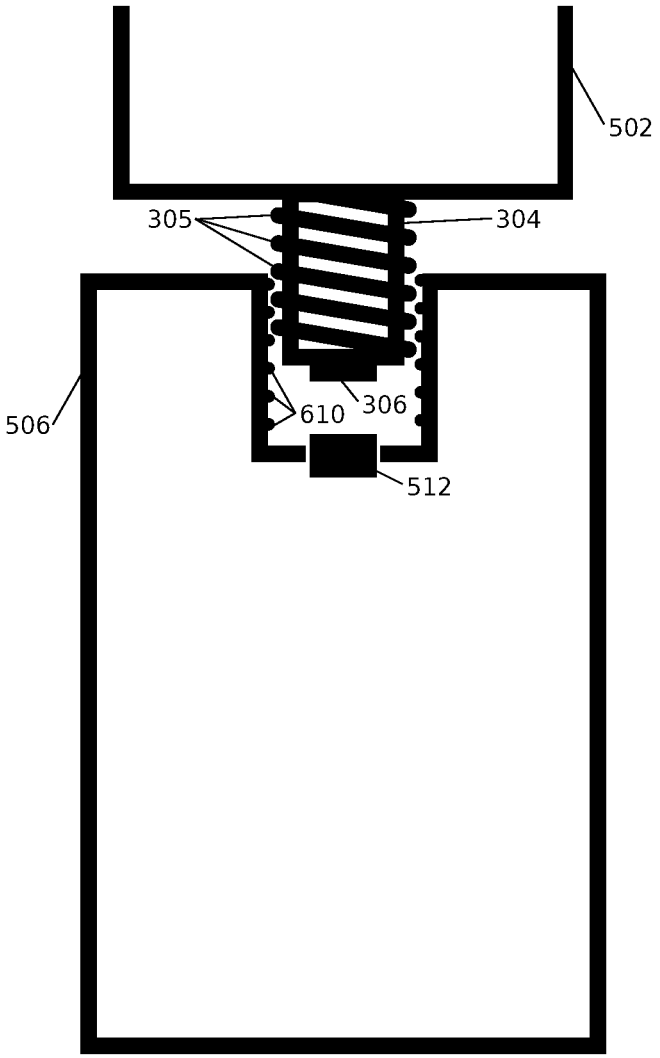
FIG. 6 is a cross-sectional view illustrating an alternate engagement of a tank with a battery assembly, in a possible embodiment of the present disclosure.

In FIG. 6 an alternate engagement or disengagement of the tank 502 to the battery assembly 506 is presented, in an embodiment of the present disclosure.

In some embodiments, as disclosed above, the tank 502 may comprise the protrusion 304, said protrusion 304 featuring the left-handed screw thread 305, said left-handed screw thread 305 formed on the surface of the protrusion 304.

In some embodiments the battery assembly 506 may comprise a matching left-handed screw thread 610 recessed into the battery assembly 506.

Through engagement and counter-clockwise rotation the tank 502 may be connected to the battery assembly 506, and conversely through clockwise rotation and disengagement the tank 502 may be removed from the battery assembly 506. Rotations are described as viewed from the top of the tank 502, that is, the tank 502 is in front of the battery assembly 506 from said view.

Figure 7A:
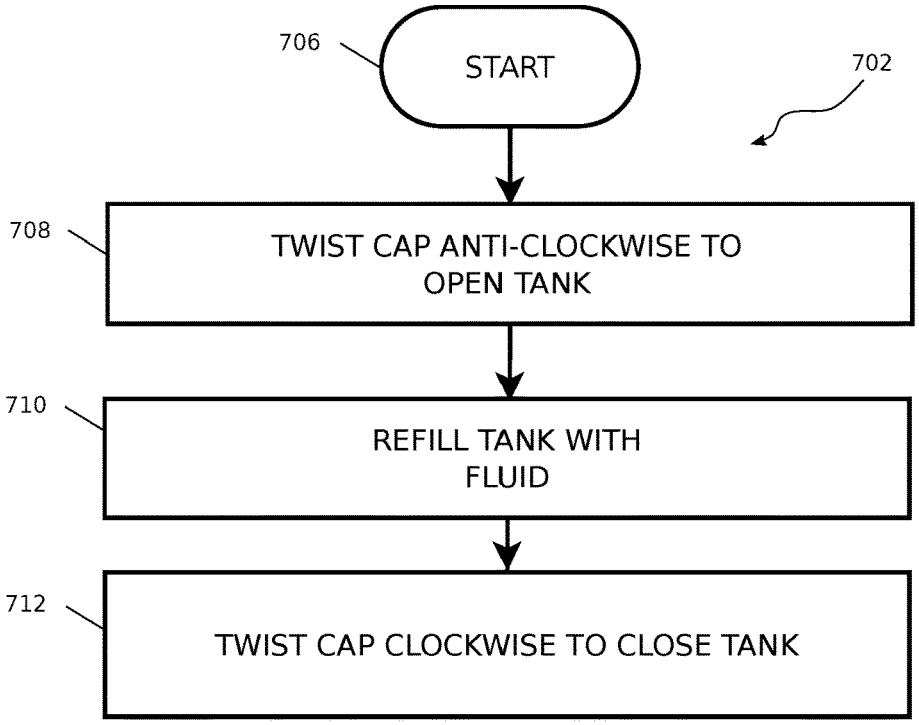
FIG. 7A is flow chart illustrating a method for refilling a tank of an electronic cigarette with e-liquid, in the third embodiment and the fourth embodiment of the present disclosure.

In FIG. 7A a flow chart illustrating a method 702 for refilling a tank of an electronic cigarette with e-liquid, in some embodiments of the present disclosure in which a cap of the tank is threaded with a right-handed screw thread and connectivity between a body of the tank and a battery assembly is enabled by a left-handed screw thread, is presented. The method 702 corresponds to embodiments disclosed in FIG. 3 and FIG. 4.

Operations may commence with step 706 and proceed to step 708, in which the cap is twisted anti-clockwise to remove the cap and open the tank.

Operations may then proceed to step 710, in which the tank may be refilled with fluid, for example e-liquid.

Operations may then proceed to step 712, in which the cap may be engaged with the body of the tank and twisted clockwise to close the tank.

Figure 7B:
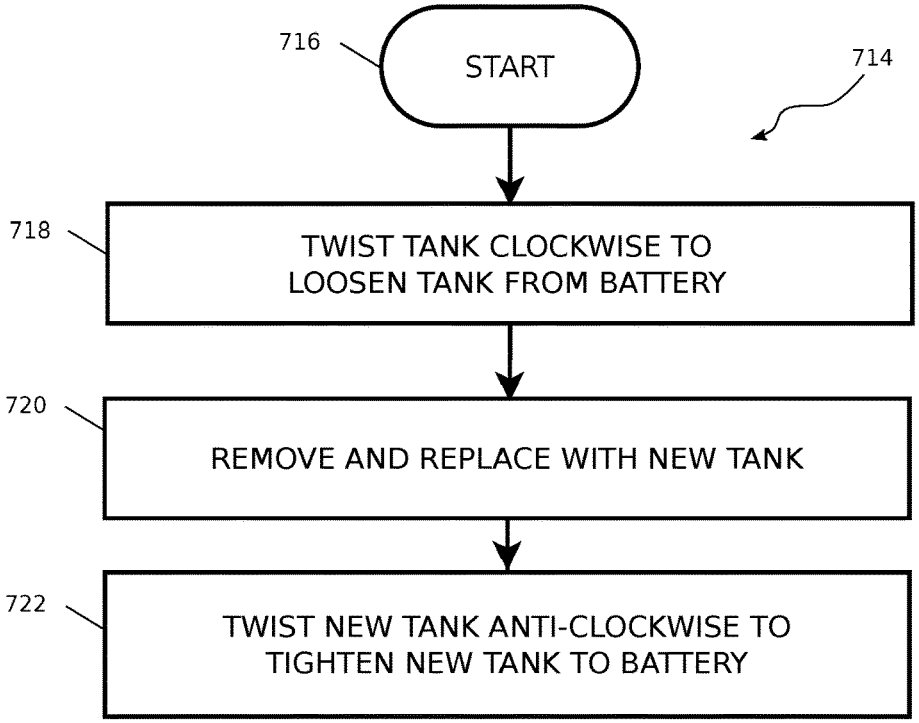
FIG. 7B is flow chart illustrating a method for replacing a tank of an electronic cigarette, in the third embodiment and the fourth embodiment of the present disclosure.

In FIG. 7B a flow chart illustrating a method 714 for replacing a tank with a new tank, in some embodiments of the present disclosure in which a cap of the tank is threaded with a right-handed screw thread and connectivity between a body of the tank and a battery assembly is enabled by a left-handed screw thread, is presented. The method 714 corresponds to embodiments disclosed in FIG. 3 and FIG. 4.

Operations may commence with step 716 and proceed to step 718, in which the tank is twisted clockwise to remove the tank from the battery assembly.

Operations may then proceed to step 720, in which the tank may be removed and replaced with a new tank.

Operations may then proceed to step 722, in which the new tank may be engaged with the battery assembly and twisted anti-clockwise to close the tank.

Figure 8A:
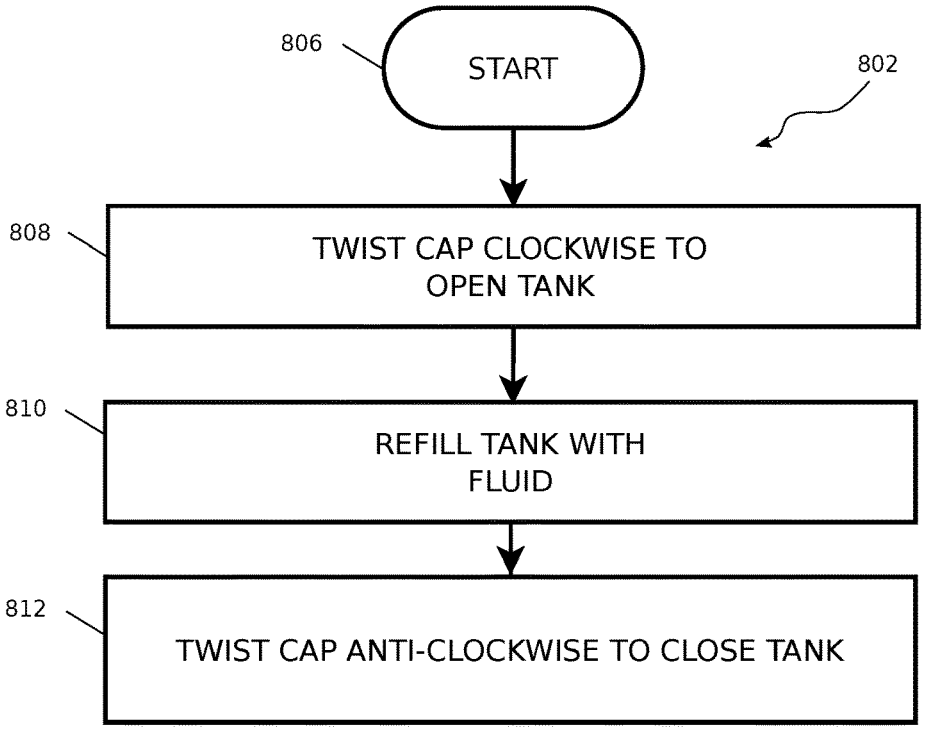
FIG. 8A is flow chart illustrating a method with a different chirality to FIG. 7A, for refilling a tank of an electronic cigarette with e-liquid, in the first embodiment and the second embodiment of the present disclosure.

In FIG. 8A a flow chart illustrating a method 802 for refilling a tank of an electronic cigarette with e-liquid, in some embodiments of the present disclosure in which a cap of the tank is threaded with a left-handed screw thread and connectivity between a body of the tank and a battery is enabled by a right-handed screw thread, is presented. The method 802 corresponds to embodiments disclosed in FIG. 1 and FIG. 2.

Operations may commence with step 806 and proceed to step 808, in which the cap is twisted clockwise to remove the cap and open the tank.

Operations may then proceed to step 810, in which the tank may be refilled with fluid, for example e-liquid.

Operations may then proceed to step 812, in which the cap may be engaged with the body of the tank and twisted anti-clockwise to close the tank.

Figure 8B:
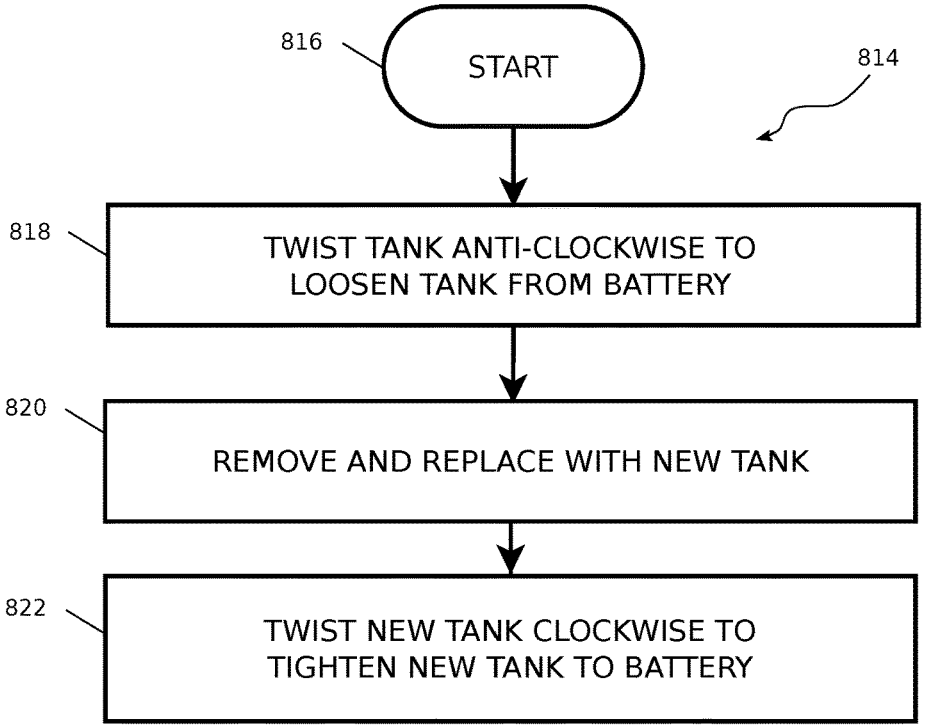
FIG. 8B is flow chart illustrating a method with a different chirality to FIG. 7B, for replacing a tank of an electronic cigarette, in the first embodiment and the second embodiment of the present disclosure.

In FIG. 8B a flow chart illustrating a method 814 for replacing a tank with a new tank, in some embodiments of the present disclosure in which a cap of the tank is threaded with a left-handed screw thread and connectivity between a body of the tank and a battery assembly is enabled by a right-handed screw thread, is presented. The method 814 corresponds to embodiments disclosed in FIG. 1 and FIG. 2.

Operations may commence with step 816 and proceed to step 818, in which the tank is twisted anti-clockwise to remove the tank from the battery assembly.

Operations may then proceed to step 820, in which the tank may be removed and replaced with a new tank.

Operations may then proceed to step 822, in which the new tank may be engaged with the battery assembly and twisted clockwise to close the tank.

The above disclosure is presented as an exemplary example of a tank system for an electronic cigarette. However, the systems and methods disclosed may equally apply to, for example, medical equipment such as atomized medicine dispensers comprising a battery, a medicine tank and a medicine in liquid form, for which it may be desirable to ensure that the medicine in liquid form is not accidentally spilled during a process of replenishing the medicine tank.

The foregoing description details certain embodiments of the systems, assemblies, and methods disclosed herein. It will be appreciated, however, that no matter how detailed the foregoing appears in text, the systems, devices, and methods can be practiced in many ways.

For example in some embodiments a protrusion from a body of a tank may be equal in width to the tank, and may be hollow in order to contain further e-liquid. Similarly, in some embodiments the protrusion may extend from the battery assembly, and the body of the tank may comprise a recessed indentation for receiving the protrusion.

For example, some embodiments may comprise a handedness of screw-threads presented in FIG. 1 or FIG. 2, and a positioning of cap screw-threads presented in FIG. 3 and FIG. 4, and vice versa.

As is also stated above, it should be noted that the use of particular terminology when describing certain features or aspects of the disclosure should not be taken to imply that the terminology is being re-defined herein to be restricted to including any specific characteristics of the features or aspects of the technology with which that terminology is associated.

It will be appreciated by those skilled in the art that various modifications and changes may be made without departing from the scope of the described technology. Such modifications and changes are intended to fall within the scope of the embodiments. It will also be appreciated by those of skill in the art that parts included in one embodiment are interchangeable with other embodiments; one or more parts from a depicted embodiment can be included with other depicted embodiments in any combination. For example, any of the various components described herein and/or depicted in the Figures may be combined, interchanged or excluded from other embodiments.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting.

As will be appreciated from the above discussion, an advantage of the systems and methods of this disclosure includes ensuring electronic cigarette e-liquid tanks may be replenished with a lowered risk of spillage and with greater ease, resulting in lower costs for electronic cigarette users and lower risks of health problems due to exposure to excessive doses of nicotine.

What is claimed is:

1. A system for a tank for an electronic cigarette comprising:

a body defining a refillable reservoir for storing e-liquid, the body comprising a left-handed thread which is engaged by a corresponding matching left-handed thread formed within a battery assembly; and a cap for sealing or partially sealing the body, the cap comprising a right-handed thread which is engaged by a corresponding matching right-handed thread formed on a surface of the body.

2. The system of claim 1, wherein the right-handed thread is formed on an outer surface of the cap and the corresponding matching right-handed thread is formed on an inner surface of the body.

3. The system of claim 1, wherein the right-handed thread is formed on an inner surface of the cap and the corresponding matching right-handed thread is formed on an outer surface of the body.

4. The system of claim 1, wherein the body comprises a protrusion, and the left-handed thread is formed on all or part of a surface of the protrusion.

5. A system for a tank for an electronic cigarette comprising:

a body defining a refillable reservoir for storing e-liquid, the body comprising a right-handed thread which is engaged by a corresponding matching right-handed thread formed within a battery assembly; and a cap for sealing or partially sealing the body, the cap comprising a left-handed thread which is engaged by a corresponding matching left-handed thread formed on a surface of the body.

6. The system of claim 5, wherein the left-handed thread is formed on an outer surface of the cap and the corresponding matching left-handed thread is formed on an inner surface of the body.

7. The system of claim 5, wherein the left-handed thread is formed on an inner surface of the cap and the corresponding matching left-handed thread is formed on an outer surface of the body.

8. The system of claim 5, wherein the body comprises a protrusion, and the right-handed thread is formed on all or part of a surface of the protrusion.

* * * * *